US009722291B2

(12) United States Patent
Kang et al.

(10) Patent No.: US 9,722,291 B2
(45) Date of Patent: Aug. 1, 2017

(54) DIELECTRIC RESONATOR, ASSEMBLY METHOD THEREOF, AND DIELECTRIC FILTER

(71) Applicant: ZTE CORPORATION, Shenzhen, Guangdong Province (CN)

(72) Inventors: Yulong Kang, Shenzhen (CN); Xiaowen Dai, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 124 days.

(21) Appl. No.: 14/651,333

(22) PCT Filed: Sep. 17, 2013

(86) PCT No.: PCT/CN2013/083674

§ 371 (c)(1),
(2) Date: Jun. 11, 2015

(87) PCT Pub. No.: WO2014/090003

PCT Pub. Date: Jun. 19, 2014

(65) Prior Publication Data

US 2015/0318594 A1 Nov. 5, 2015

(30) Foreign Application Priority Data

Dec. 11, 2012 (CN) ..... 2012 1 0531727

(51) Int. Cl.
*H01P 7/10* (2006.01)
*H01P 1/203* (2006.01)
(Continued)

(52) U.S. Cl.
CPC ..... *H01P 7/10* (2013.01); *H01P 1/2084* (2013.01); *H01P 1/20309* (2013.01);
(Continued)

(58) Field of Classification Search
CPC ..... H01P 1/205; H01P 1/2053; H01P 7/10; H01P 7/06; H01P 1/2084
(Continued)

(56) References Cited

U.S. PATENT DOCUMENTS 6,535,086 B1 3/2003 Liang et al.
2005/0030131 A1* 2/2005 Yamakawa ..... H01P 7/10 333/202

(Continued)

FOREIGN PATENT DOCUMENTS

CN 202217778 U 5/2002
CN 1581569 A 2/2005

(Continued)

*Primary Examiner* — Benny Lee
*Assistant Examiner* — Hafizur Rahman
(74) *Attorney, Agent, or Firm* — Ling Wu; Stephen Yang; Ling and Yang Intellectual Property

(57) ABSTRACT

The dielectric resonator includes a sealing cover, a dielectric resonant column, a metal cavity, and an electrically-conductive elastic structure body. The dielectric resonant column is located within the metal cavity, wherein the sealing cover is connected to an upper surface of the dielectric resonant column. The sealing cover is located at the upper end face of the metal cavity and is configured to seal the metal cavity. The metal cavity is provided with a groove at the bottom. The electrically-conductive elastic structure body is located within the groove and is configured to support the dielectric resonant column. The depth of the groove causes a lower surface of the dielectric resonant column to be lower than an inner bottom surface of the metal cavity after the sealing cover seals the metal cavity. A lower end face of the dielectric resonant column is in contact with the electrically-conductive elastic structure body.

14 Claims, 3 Drawing Sheets

(51) Int. Cl.
*H01P 11/00* (2006.01)
*H01P 1/208* (2006.01)

(52) U.S. Cl.
CPC ..... *H01P 11/006* (2013.01); *H01P 11/007* (2013.01); *H01P 11/008* (2013.01); *Y10T 29/49018* (2015.01)

(58) Field of Classification Search
USPC ..... 333/219.1, 222, 235, 202, 212, 209
See application file for complete search history.

(56) References Cited

U.S. PATENT DOCUMENTS

| | | | | |
|---|---|---|---|---|
| 2008/0272861 | A1 | 11/2008 | Henault et al. | |
| 2012/0326811 | A1* | 12/2012 | Resnati ..... | H01P 7/10 333/234 |

FOREIGN PATENT DOCUMENTS

| | | | |
|---|---|---|---|
| CN | 101546857 | A | 9/2009 |
| CN | 201673986 | U | 12/2010 |
| CN | 102148417 | A | 8/2011 |
| CN | 102368574 | A | 3/2012 |
| CN | 102509826 | A | 6/2012 |
| EP | 2538487 | A1 | 12/2012 |
| JP | 2005033327 | A | 2/2005 |
| WO | 2010013982 | A2 | 2/2010 |

* cited by examiner

DIELECTRIC RESONATOR, ASSEMBLY METHOD THEREOF, AND DIELECTRIC FILTER

TECHNICAL FIELD

The present document relates to the mobile communication field, and in particular, to a dielectric resonator, an assembly method thereof and a dielectric filter.

BACKGROUND OF THE RELATED ART

When the electromagnetic wave is propagated in the high dielectric constant material, its wavelength can be shortened. By utilizing the theory, the dielectric material can be used to replace the traditional metal material, and under the same index, the volume of the wave filter can be reduced. The research on the dielectric filter is a hot spot of the communication industry all the time. The wave filter is regarded as the important component of the wireless communication products, and the dielectric filter is very important for the miniaturization of the communication products.

Usually the TM (horizontal magnetism) mode dielectric filter is mainly composed of the dielectric resonant column 103, the sealing cover 102, the tuning screw 101, and the metal cavity 104, referring to FIG. 1.

According to the operating principle of the TM mode dielectric resonant cavity, when the dielectric resonator works normally, there is the high electric field distribution in the combining sites of the upper and lower end faces of the dielectric resonant column 103 with the metal cavity 104. If the upper and lower end faces of the dielectric resonant column do not keep in touch with the metal cavity 104 sufficiently, it will cause that the impedance is discontinuous, the field energy cannot be transmitted out, the high dielectric constant and high quality factor of the dielectric cannot be exerted, and even the dielectric will be burn. So, it is particularly crucial whether the upper and lower surfaces of the dielectric resonant column keep in touch with the surfaces of the metal cavity well in the TM mode dielectric filter. How to solve the fixation and contact of the TM mode dielectric resonant column becomes the key research direction of the dielectric filter application.

The dielectric resonator of the related art refers to FIG. 1, wherein the upper surface of the dielectric resonant column 103 is crimped by the sealing cover 102, used for the close contact of the dielectric and the sealing cover 102; and the lower surface of the dielectric resonant column 103 is welded or closely connected to the metal cavity 104 in other ways, used for close contact with the bottom surface of the metal cavity. The sealing cover 102 and the metal cavity 104 are sealed through the screw, to form one closed cavity. Because the temperature coefficient of the dielectric resonant column is different from that of the metal material, once that kind of resonant cavity is influenced by the temperature to swell or shrink, the whole upper surface of the dielectric resonant column will have the interval or be pushed, which influences the performance and service life of the filter seriously.

The solution of the related art is to add the conductive elastomer between the cover and the dielectric resonant column, and that conductive elastomer is used for contacting the cover with the dielectric resonant column. The dielectric filter guarantees the good contact of the dielectric resonant column and the cover by relying on that the conductive elastomer springs back under press. But because the dielectric resonator is only connected by several contacts of the spring, and the contact area and depth of the contacts are not the same when the cavity swells or shrinks with the change of the temperature, thus causing the change of the performance index of the filter.

SUMMARY OF THE INVENTION

The embodiment of the present invention provides a dielectric resonator and an assembly method thereof and the dielectric filter manufactured by the dielectric resonator, which guarantees the good contact of the dielectric resonant column and the metal cavity in the dielectric resonator, without being influenced by the temperature, and improves the performance of the dielectric resonator.

A dielectric resonator provided by the embodiment of the present invention comprises: a sealing cover, a dielectric resonant column, a metal cavity, and an electrically-conductive elastic structure body; the dielectric resonant column located within the metal cavity; wherein, the sealing cover is connected to an upper surface of the dielectric resonant column, the sealing cover is located at an upper end face of the metal cavity, and the sealing cover is configured to seal the metal cavity;

the metal cavity is provided with a groove at bottom, the electrically-conductive elastic structure body is located within the groove at the bottom of the metal cavity, and the electrically-conductive elastic structure body is configured to support the dielectric resonant column, and the depth of the groove causes a lower surface of the dielectric resonant column to be lower than an inner bottom surface of the metal cavity after the sealing cover seals the metal cavity; and a lower end face of the dielectric resonant column is in contact with the electrically-conductive elastic structure body.

Preferably, the sealing cover is connected with the upper surface of the dielectric resonant column, comprising: the sealing cover is connected through welding with the upper surface of the dielectric resonant column.

Preferably, the metal cavity is provided with a bulge within the groove at the bottom; the electrically-conductive elastic structure body has a middle hole, and the middle hole and the bulge at the bottom within the metal cavity are matched and connected, so that relative location of the electrically-conductive elastic structure body to the metal cavity is fixed.

Preferably, the electrically-conductive elastic structure body comprises an elastic washer.

Preferably, the dielectric resonator further comprises a tuning screw configured to adjust a frequency of the dielectric resonator; and the tuning screw passes through the sealing cover from the top of the metal cavity into the dielectric resonant column, or, the tuning screw passes through the metal cavity and electrically-conductive elastic structure body from the bottom of the metal cavity into the dielectric resonant column.

The embodiment of the present invention further provides a dielectric filter, formed by connecting two or more dielectric resonators mentioned above.

The embodiment of the present invention further provides a method for assembling a dielectric resonator, comprising:

connecting a sealing cover with an upper surface of a dielectric resonant column;

placing an electrically-conductive elastic structure body within a groove at the bottom of a metal cavity, and the depth of the groove at the bottom of the metal cavity causing a lower surface of the dielectric resonant column to be lower than an inner bottom surface of the metal cavity after the sealing cover is connected with an upper end face of the metal cavity; and connecting the sealing cover with the upper end face of the metal cavity, and a lower end face of the dielectric resonant column being in contact with the electrically-conductive elastic structure at the same time.

Preferably, the metal cavity is provided with a bulge within the groove at the bottom; the electrically-conductive elastic structure body has a middle hole, the electrically-conductive elastic structure body is placed in the groove at the bottom of the metal cavity, comprising: matching and connecting the electrically-conductive elastic structure body and the bulge at the bottom of the metal cavity.

Preferably, the method further comprises: stretching a tuning screw from the top of the metal cavity through the sealing cover into the dielectric resonant column.

Preferably, the method further comprises: stretching the tuning screw from the bottom of the metal cavity through the metal cavity and electrically-conductive elastic structure body into the dielectric resonant column.

In the embodiment of the present invention, it guarantees the good contact of the dielectric resonant column and the metal cavity according to the resilience of the electrically-conductive elastic structure body under press. Even if the metal cavity is compressed or swelled under the influence of external force or temperature condition, it also can guarantee the good contact, and because the depth of the groove at the bottom of the metal cavity causes the lower surface of the dielectric resonant column to be lower than the inner bottom surface of the metal cavity after the sealing cover seals the metal cavity, thus improving the performance of the dielectric resonator.

PREFERRED EMBODIMENTS OF THE PRESENT INVENTION

The embodiment of the present invention is described in detail with reference to the accompanying drawings hereinafter. It should be illustrated that, in the case of not conflicting, the embodiments in the present application and features in these embodiments can be combined with each other.

Embodiment 1

Figure 1:
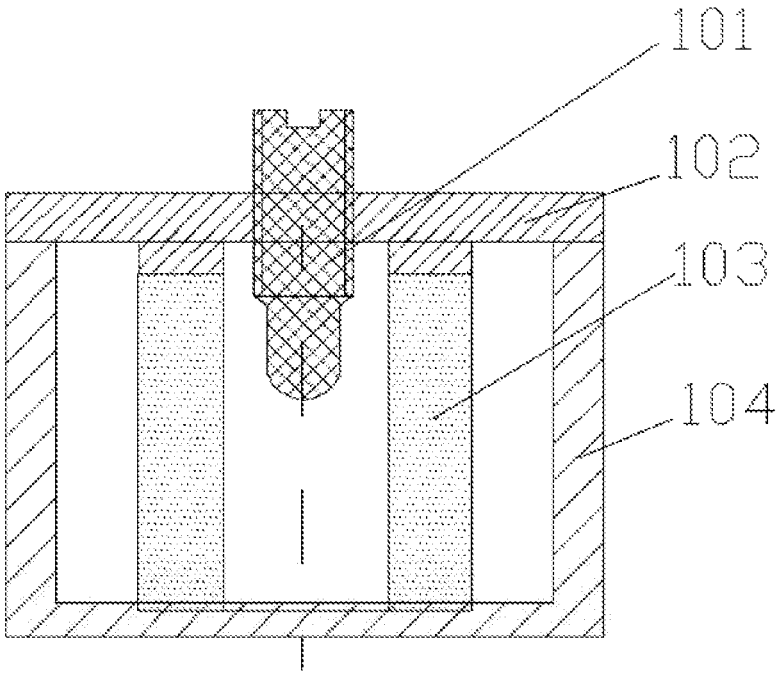
FIG. 1 Prior Art
FIG. 1 is a diagram of a TM mode dielectric resonator in the related art.
Figure 2:
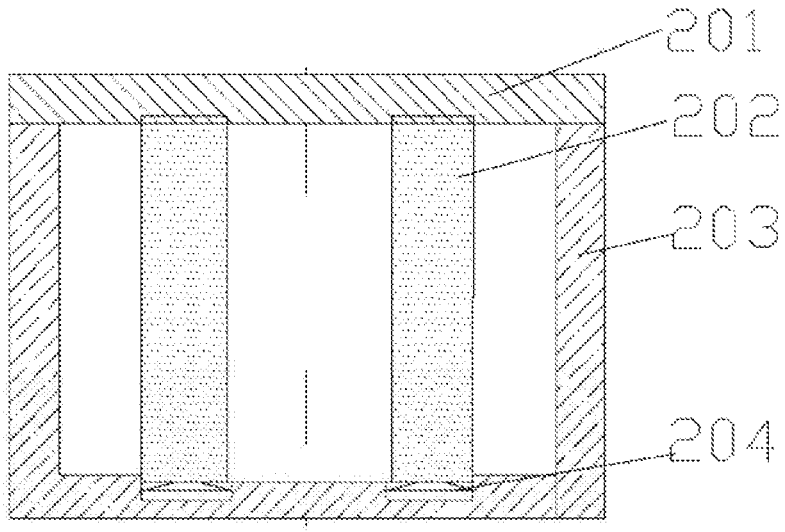
FIG. 2 is a structure diagram of a dielectric resonator in the embodiment 1 of the present invention.

The dielectric resonator is introduced in the present embodiment, as shown in FIG. 2, including: a sealing cover 201, a dielectric resonant column 202, a metal cavity 203, and an electrically-conductive elastic structure body 204; the dielectric resonant column 202 located within the metal cavity 203; wherein:

the sealing cover 201 is connected to an upper surface of the dielectric resonant column 202, and the sealing cover 201 is located at an upper end face of the metal cavity 203 and configured to seal the metal cavity 203;

the metal cavity 203 is provided with a groove at bottom, and the electrically-conductive elastic structure body 204 is located within the groove at the bottom of the metal cavity 203, configured to support the dielectric resonant column 202, and the depth of the groove causes a lower surface of the dielectric resonant column 202 to be lower than an inner bottom surface of the metal cavity 203 after the sealing cover 201 seals the metal cavity 203; and the lower end face of the dielectric resonant column 202 is in contact with the electrically-conductive elastic structure body 204.

The sealing cover 201 is connected tightly with the upper surface of the dielectric resonant column 202 by adopting the welding or other ways.

After the sealing cover 201 is connected with metal cavity 203, the electrically-conductive elastic structure body 204 located under the dielectric resonant column 202 is in the stress-resilience state because of suffering the gravity pressure of the dielectric resonant column 202, which can guarantee the good contact with the dielectric resonant column 202 and the metal cavity 203. In addition, the lower surface of the dielectric resonant column 202 is lower than the inner bottom surface of the metal cavity 203, so, the transmission path of the electromagnetic wave can be improved, thus promoting the electrical performance of the resonant cavity. Even if the metal cavity 203 is compressed or swelled under the influence of external force or temperature condition; it also can guarantee the good contact of the metal cavity 203 and the dielectric resonant column 202, thus improving the performance of the dielectric resonator and reducing the volume of the whole filter.

Preferably, after the sealing cover 201 is connected with the metal cavity 203, the electrically-conductive elastic structure body 204 has the tensile and compress margins, to better fit the swelling or shrinking of cavity after the metal cavity 203 is changed along with the temperature.

The electrically-conductive elastic structure body 204 can be put in the groove directly, and also can be fixed in the groove at the bottom in other ways, in order to keep the close contact of the electrically-conductive elastic structure body 204 with the dielectric resonant column 202 and the metal cavity 203.

In one preferable embodiment, the metal cavity 203 is provided with a bulge in the groove at the bottom; the electrically-conductive elastic structure body 204 has a middle hole, and the middle hole and the bottom bulge in the metal cavity are matched and connected, so that the relative location of the electrically-conductive elastic structure body to the metal cavity is fixed. When there is a bulge, the groove at the bottom in the metal cavity 203 is a ring-type groove.

In a preferable embodiment, the dielectric resonator further includes a tuning screw configured to adjust a frequency of the dielectric resonator; and the tuning screw can pass through the sealing cover from the top of the metal cavity into the dielectric resonant column, or, it also can pass through the metal cavity and electrically-conductive elastic structure body from the bottom of the metal cavity into the dielectric resonant column, specifically referring to the application example.

More than two (including two) dielectric resonators mentioned above are connected together, which can form a multiple-stage dielectric filter.

Embodiment 2

Figure 3:
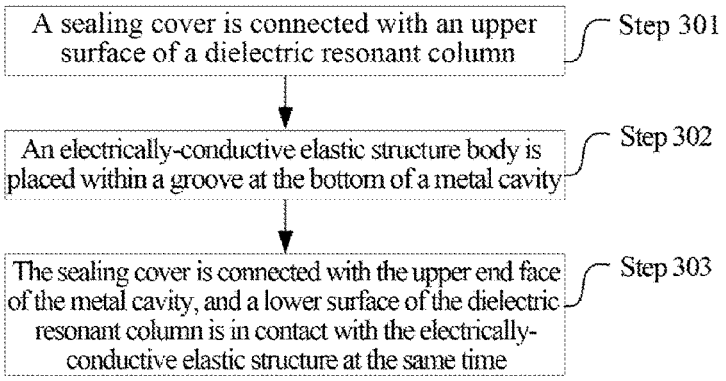
FIG. 3 is a flow chart of an assembly method of the embodiment 2 of the present invention.

The present embodiment introduces the method for assembling the above-mentioned dielectric resonator, as shown in FIG. 3, including the following steps.

In step 301, a sealing cover is connected with an upper surface of a dielectric resonant column.

In step 302, an electrically-conductive elastic structure body is placed within a groove at the bottom of a metal cavity, and the depth of the groove at the bottom of the metal cavity causes a lower surface of the dielectric resonant column to be lower than an inner bottom surface of the metal cavity after the sealing cover is connected with the upper end face of the metal cavity.

In step 303, the sealing cover is connected with the upper end face of the metal cavity, and a lower end face of the dielectric resonant column is in contact with the electrically-conductive elastic structure at the same time.

In one preferable embodiment, the metal cavity is provided with a bulge in the groove at the bottom; the electrically-conductive elastic structure body has a middle hole, and the electrically-conductive elastic structure body and the bulge at the bottom of the metal cavity are matched and connected.

In one preferable embodiment, the above-mentioned method further includes: stretching a tuning screw from the top of the metal cavity through the sealing cover into the dielectric resonant column; or stretching the tuning screw from the bottom of the metal cavity through the metal cavity and electrically-conductive elastic structure body into the dielectric resonant column.

The above-mentioned dielectric resonator is illustrated with an example of taking the elastic washer as the electrically-conductive elastic structure body hereinafter.

Application Example 1

Figure 4:
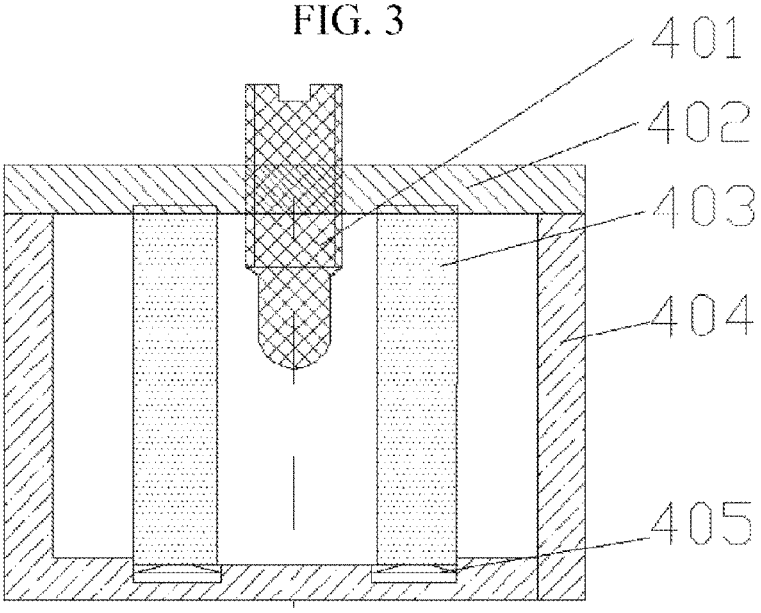
FIG. 4 is a structure diagram of a dielectric resonator in application example 1 of the present invention.

The present example introduces a dielectric resonator, as shown in FIG. 4, and the dielectric resonator includes a dielectric resonant column 403, a sealing cover 402, an elastic washer 405, a metal cavity 404 and a tuning screw 401, wherein:

the dielectric resonant column 403 is located within the metal cavity 404, and the upper surface of the dielectric resonant column 403 and the sealing cover 402 are tightly connected by welding or using other ways;

the sealing cover 402 is located on the upper surface of the metal cavity 404, that it, the top end, configured to seal the metal cavity 404;

the elastic washer 405 is located between the metal cavity 404 and the dielectric resonant column 403, in the contact and connection with the two, and its elastic characteristic and conductive characteristic can guarantee the good contact of the metal cavity 404 and the dielectric resonant column 403, thus guaranteeing the performance of the dielectric resonant cavity.

The assembly process of the dielectric resonator is: welding the dielectric resonant column 403 or using other ways to tightly connect to the sealing cover 402 at first, and then placing the elastic washer 405 in the groove in the bottom surface of the metal cavity 404 (such as, in the circular groove), and then placing the assembled sealing cover 402 with the dielectric resonant column on the metal cavity 404 and then fixing and sealing it, and then assembling the tuning screw 401, wherein the tuning screw 401 is located in the center location of the dielectric resonator 403, and the tuning screw 401 is stretched from the top of the metal cavity through the sealing cover 402 into the dielectric resonant column 403; after the whole assembly process is completed, the elastic washer 405 suffers the pressure of the dielectric resonant column 403, and it is in the elastic deformation state all the time.

Preferably, the depth of the groove causes the lower surface of the dielectric resonant column 403 to be lower than the bottom surface of the metal cavity, according to the theory of electromagnetic field, which helps the transmission of the electric field in the dielectric.

Application Example 2

Figure 5:
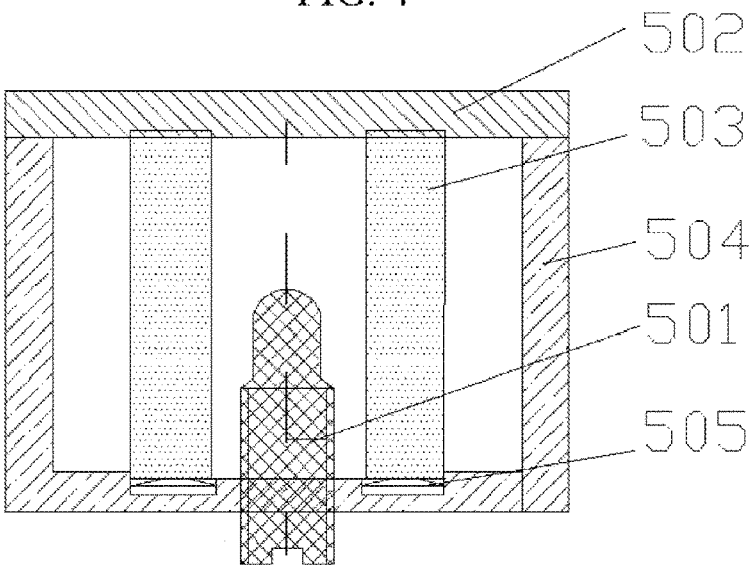
FIG. 5 is a structure diagram of a dielectric resonator in application example 2 of the present invention.

The present example introduces a dielectric resonator, as shown in FIG. 5, and the dielectric resonator includes a dielectric resonant column 503, a sealing cover 502, an elastic washer 505, a metal cavity 504 and a tuning screw 501. The upper surface of the dielectric resonant column 503 and the sealing cover 502 are connected together closely by welding or other ways; the lower surface of the dielectric resonant column 503 keeps in touch with the metal cavity 504 closely through the elastic washer 505. The difference from the application example 1 lies in that, the tuning screw 501 in the present example is stretched from the bottom of the metal cavity 504 through the metal cavity 504 and elastic washer 505 into the dielectric resonant column 503, and the tuning screw 501 is configured to adjust the frequency of the dielectric resonator.

If the bottom of the metal cavity 504 is provided with a bulge, and the bulge has a threaded hole at this moment, then the threaded hole realizes the connection of the tuning screw 501 with the metal cavity 504, and the external diameter of the bulge is less than the diameter of the middle hole of the elastic washer 505, for fixing the position of the elastic washer 505.

Application Example 3

Figure 6:
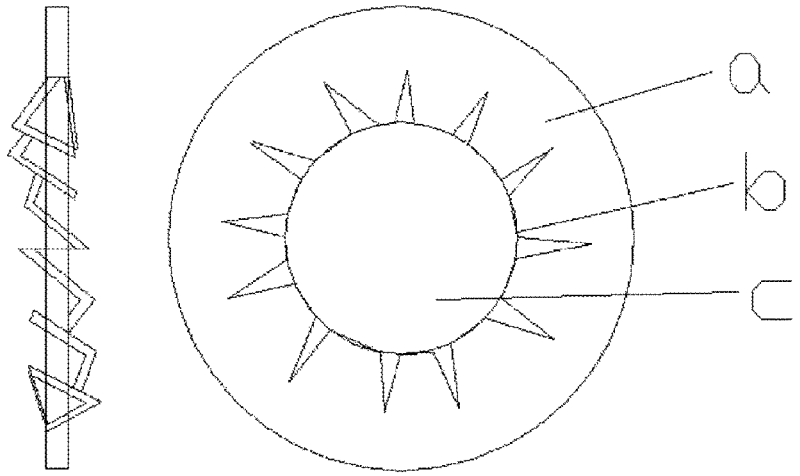
FIG. 6 is a structure diagram of an elastic washer in application example 3 of the present invention.

The present example introduces the electrically-conductive elastic structure body 204 in the above-mentioned embodiments, which is made of the metal with good conductivity, such as, the silvered spring plate, and the copper plate can also be adopted. The electrically-conductive elastic structure body 204 can be the elastic washer as shown in FIG. 6, and the elastic washer includes the edge a and the elastic teeth b in the present example.

The outside of the edge a keeps in touch with the metal cavity.

The upper surface of the elastic teeth b keeps in touch with the lower surface of the dielectric resonant column, and the lower surface of the elastic teeth keeps in touch with the metal cavity, and the elastic teeth b appears to be in a stressed deformation state after the assembly is completed.

When there is a bulge at the bottom in the metal cavity, the elastic washer can also include a middle hole c, and the middle hole c and the bulge at the bottom in the metal cavity are matched and connected, so that the relative location of the elastic washer to the metal cavity is fixed, which avoids the elastic washer from slipping out of the groove.

One realization mode of the elastic teeth is the bilateral teeth as shown in FIG. 6, that is, both the top and bottom of the edge have the elastic teeth; another feasible realization mode is the unilateral teeth, that is, the top of the edge has the elastic teeth.

Figure 7:
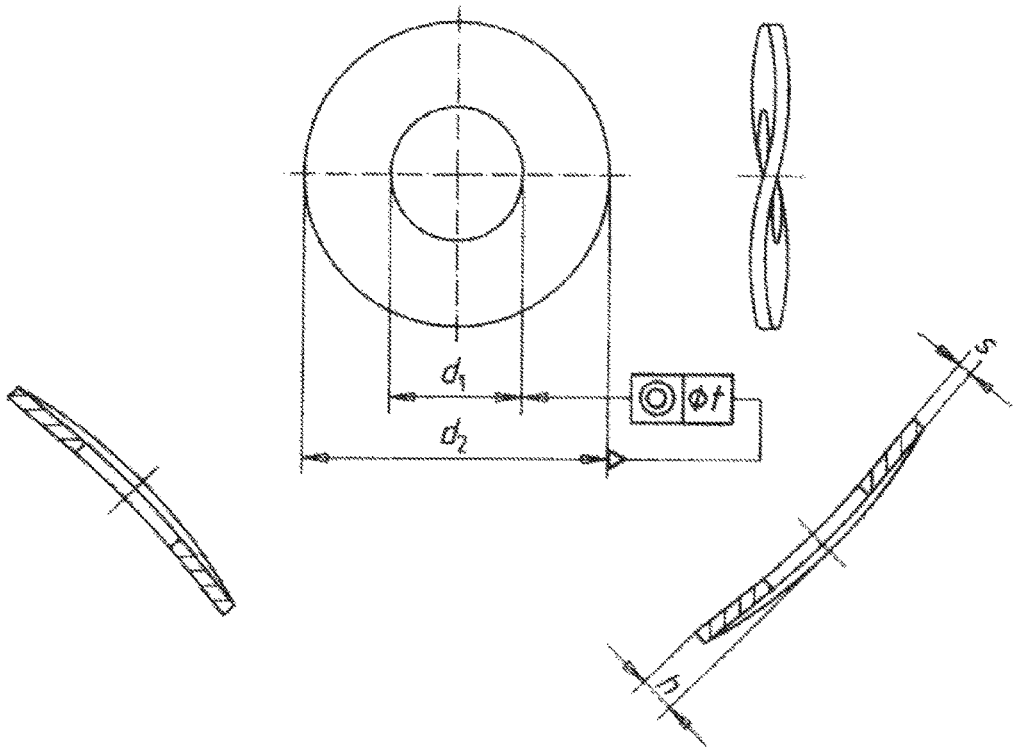
FIG. 7 is a structure diagram of a corrugate O ring in application example 3 of the present invention.

In addition, the electrically-conductive elastic structure body 204 can also be realized by adopting the integrated structure, the corrugate O ring, as shown in FIG. 7. In FIG. 7, d1 is the internal diameter of the O ring, d2 is the external diameter of the O ring, the minimum height of the O ring is s, and the maximum height is h.

The dielectric resonator provided by the embodiment of the present invention can guarantee that the dielectric resonant column and the metal cavity are contacted closely, and the filtering performance of the dielectric resonator is stable and reliable, the production technology is simple, and the volume of the dielectric resonator is reduced.

For those skilled in the art, the duplexer and the filter can be combined or changed according to the technical scheme and its conception of the embodiment of the present invention, to design other duplex and filter integrated modules with other combination structures, and all these changes or replacements should belong to the protection scope of the appended claims of the present document.

It can be understood by those skilled in the art that all or part of steps in the above-mentioned method can be fulfilled by programs instructing the relevant hardware components, and the programs can be stored in a computer readable storage medium such as a read only memory, a magnetic disk or an optical disk, etc. Alternatively, all or part of the steps in the above-mentioned embodiments can be implemented with one or more integrated circuits. Accordingly, each module/unit in the above-mentioned embodiments can be implemented in the form of hardware, or in the form of software function module. The present document is not limit to any specific form of the combination of the hardware and software.

The present document can have a variety of other embodiments. Those skilled in the art can make the corresponding modifications and variations according to the present document without departing from the spirit and essence of the present document. And all of these modifications or the variations should be included in the protection scope of the appended claims of the present document.

INDUSTRIAL APPLICABILITY

In the embodiment of the present invention, it guarantees the good contact of the dielectric resonant column and the metal cavity according to the resilience of the electrically-conductive elastic structure body under press. Even if the metal cavity is compressed or swelled under the influence of external force or temperature condition, it also can guarantee the good contact, and because the depth of the groove at the bottom of the metal cavity causes the lower surface of the dielectric resonant column to be lower than the inner bottom surface of the metal cavity after the sealing cover seals the metal cavity, thus improving the performance of the dielectric resonator.

What we claimed is:

1. A dielectric resonator, comprising: a sealing cover, a dielectric resonant column, a metal cavity, and an electrically-conductive elastic structure body, the dielectric resonant column located within the metal cavity, wherein:

the sealing cover is connected to an upper surface of the dielectric resonant column, and the sealing cover is located at an upper end face of the metal cavity, and the sealing cover is configured to seal the metal cavity;

the metal cavity is provided with a groove at an inner bottom surface, and the electrically-conductive elastic structure body is located within the groove at the inner bottom surface of the metal cavity, and the electrically-conductive elastic structure body is configured to support the dielectric resonant column, and the depth of the groove causes a lower surface of the dielectric resonant column to be lower than the inner bottom surface of the metal cavity after the sealing cover seals the metal cavity; and a lower end face of the dielectric resonant column is in contact with the electrically-conductive elastic structure body;

wherein the metal cavity is provided with a bulge in the groove at the inner bottom surface; the electrically-conductive elastic structure body has a middle hole, and the middle hole of the electrically-conductive elastic structure body and the bulge in the groove at the inner bottom surface of the metal cavity are matched and connected, so that the relative location of the electrically-conductive elastic structure body to the metal cavity is fixed.

2. The dielectric resonator according to claim 1, wherein:

the sealing cover is connected with the upper surface of the dielectric resonant column, comprising: the sealing cover connected through welding with the upper surface of the dielectric resonant column.

3. A dielectric filter, formed by connecting two or more dielectric resonators, wherein each of the two or more dielectric resonators are dielectric resonators described in claim 2.

4. The dielectric resonator according to claim 1, wherein:

the electrically-conductive elastic structure body comprises an elastic washer.

5. The dielectric resonator according to claim 1, wherein:

the dielectric resonator further comprises a tuning screw configured to adjust a frequency of the dielectric resonator; and the tuning screw passes from a top of the metal cavity through the sealing cover into the dielectric resonant column, or, the tuning screw passes from a bottom of the metal cavity through the metal cavity and electrically-conductive elastic structure body into the dielectric resonant column.

6. A dielectric filter, formed by connecting two or more dielectric resonators, wherein each of the two or more dielectric resonators are dielectric resonators described in claim 1.

7. A method for assembling a dielectric resonator, comprising:

connecting a sealing cover with an upper surface of a dielectric resonant column;

placing an electrically-conductive elastic structure body within a groove at an inner bottom surface of a metal cavity, and the depth of the groove at the inner bottom surface of the metal cavity causing a lower surface of the dielectric resonant column to be lower than the inner bottom surface of the metal cavity after the sealing cover is connected with an upper end face of the metal cavity; and connecting the sealing cover with the upper end face of the metal cavity, and a lower surface of the dielectric resonant column being in contact with the electrically-conductive elastic structure at the same time;

wherein the metal cavity is provided with a bulge in the groove at the inner bottom surface, and the electrically-conductive elastic structure body has a middle hole, and placing the electrically-conductive elastic structure body within the groove at the inner bottom surface of the metal cavity comprises: matching and connecting the middle hole of the electrically-conductive elastic structure body and the bulge in the groove at the inner bottom surface of the metal cavity, so that the relative location of the electrically-conductive elastic structure body to the metal cavity is fixed.

8. The dielectric resonator according to claim 4, wherein:

the dielectric resonator further comprises a tuning screw configured to adjust a frequency of the dielectric resonator; and the tuning screw passes from a top of the metal cavity through the sealing cover into the dielectric resonant column, or, the tuning screw passes from a bottom of the metal cavity through the metal cavity and electrically-conductive elastic structure body into the dielectric resonant column.

9. The method according to claim 7, further comprising:

inserting a tuning screw through the sealing cover of a to of the metal cavity into the dielectric resonant column.

10. The method according to claim 7, further comprising:

inserting a tuning screw through a bottom of the metal cavity and electrically-conductive elastic structure body into the dielectric resonant column.

11. The dielectric resonator according to claim 2, wherein:

the dielectric resonator further comprises a tuning screw configured to adjust a frequency of the dielectric resonator; and the tuning screw passes from a top of the metal cavity through the sealing cover into the dielectric resonant column, or, the tuning screw passes from a bottom of the metal cavity through the metal cavity and electrically-conductive elastic structure body into the dielectric resonant column.

12. A dielectric filter, formed by connecting two or more dielectric resonators, wherein each of the two or more dielectric resonators are dielectric resonators described in claim 4.

13. A dielectric filter, formed by connecting two or more dielectric resonators, wherein each of the two or more dielectric resonators are dielectric resonators described in claim 5.

14. A dielectric filter, formed by connecting two or more dielectric resonators, wherein each of the two or more dielectric resonators are dielectric resonators described in claim 11.

* * * * *